US007735439B1

(12) United States Patent
Price et al.

(10) Patent No.: US 7,735,439 B1
(45) Date of Patent: Jun. 15, 2010

(54) PANEL QUILTING MACHINE

(75) Inventors: Elvin C. Price, Dacula, GA (US); Preston B. Dasher, Lawrenceville, GA (US); Michael G. Baker, Hoschton, GA (US); Danny V. Murphy, Dacula, GA (US); George A. Price, Lawrenceville, GA (US); John P. Phillips, Lawrenceville, GA (US); Jeffrey S. Kane, Lawrenceville, GA (US)

(73) Assignee: Atlanta Attachment Company, Lawrenceville, GA (US)

( * ) Notice: Subject to any disclaimer, the term of this patent is extended or adjusted under 35 U.S.C. 154(b) by 743 days.

(21) Appl. No.: 11/677,778

(22) Filed: Feb. 22, 2007

Related U.S. Application Data

(60) Provisional application No. 60/775,657, filed on Feb. 22, 2006.

(51) Int. Cl.
*D05B 11/00* (2006.01)
*D05B 37/00* (2006.01)

(52) U.S. Cl. ..... 112/117

(58) Field of Classification Search ..... 117/83, 117/117, 98, 102, 100, 118, 470.09, 122–130, 117/303–305, 220, 221, 235–240; 83/491, 83/495, 935–940
See application file for complete search history.

(56) References Cited

U.S. PATENT DOCUMENTS 3,698,335 A 10/1972 Forrester, et al.
3,867,891 A 2/1975 Grabher
4,018,175 A 4/1977 Forrester et al.
5,005,499 A 4/1991 Landoni
5,154,130 A 10/1992 Gribetz et al.
5,269,238 A 12/1993 Landoni
5,373,795 A * 12/1994 Kato ..... 112/236
5,505,150 A 4/1996 James et al.
5,509,365 A 4/1996 Cash (Continued)

FOREIGN PATENT DOCUMENTS

EP 0394601 10/1990

(Continued)

OTHER PUBLICATIONS

*Dueff SM205 Description*, http://www.dueffeitaly.it/Eng/205-eng-main.htm; Dec. 21, 2004.

(Continued)

*Primary Examiner*—Ismael Izaguirre
(74) *Attorney, Agent, or Firm*—Womble Carlyle Sandridge & Rice PLLC

(57) ABSTRACT

A system for quilting fabric materials includes a quilter unit having a reciprocating needle bar with a series of needles spaced therealong and carrying a series of threads for forming quilted patterns in fabric materials passing below the needles. The quilted fabric materials then can be collected on a supply roll or fed to a panel cutter downstream from the quilter unit. The panel cutter can include a panel cutting blade for cutting the quilted material in different panel lengths or sizes, as well as a series of slitting blades that can be moved into engagement with the quilted material for forming strips of the quilted material in desired widths.

25 Claims, 10 Drawing Sheets

U.S. PATENT DOCUMENTS

| | | | | |
|---|---|---|---|---|
| 5,544,599 | A | 8/1996 | Frazer et al. | |
| 5,603,270 | A | 2/1997 | White et al. | |
| 5,617,802 | A | 4/1997 | Cash | |
| 5,832,849 | A | 11/1998 | Kaetterhenry et al. | |
| 5,839,382 | A * | 11/1998 | Tice et al. | 112/470.04 |
| 5,967,068 | A | 10/1999 | Landoni | |
| 6,026,756 | A | 2/2000 | Frazer et al. | |
| 6,105,520 | A | 8/2000 | Frazer et al. | |
| 6,145,456 | A | 11/2000 | Codos | |
| 6,158,366 | A | 12/2000 | Codos | |
| 6,170,414 | B1 | 1/2001 | Kaetterhenry et al. | |
| 6,237,517 | B1 | 5/2001 | Bondanza et al. | |
| 6,263,816 | B1 | 7/2001 | Codos et al. | |
| 6,312,123 | B1 | 11/2001 | Condos et al. | |
| 6,435,117 | B2 | 8/2002 | Codos et al. | |
| 6,523,921 | B2 | 2/2003 | Condos | |
| 6,736,078 | B2 | 5/2004 | Kaetterhenry et al. | |
| 6,796,254 | B2 | 9/2004 | Bondanza et al. | |
| 6,848,846 | B2 | 2/2005 | Codos et al. | |
| 6,895,878 | B2 | 5/2005 | Stutznacker | |
| 7,073,453 | B2 * | 7/2006 | Frazer et al. | 112/117 |
| 2002/0104468 | A1 | 8/2002 | Myers et al. | |
| 2002/0166467 | A1 | 11/2002 | Codos et al. | |
| 2004/0237864 | A1 | 12/2004 | Frazer et al. | |
| 2005/0051071 | A1 | 3/2005 | Codos et al. | |
| 2005/0211031 | A1 | 9/2005 | James et al. | |
| 2006/0179989 | A1 | 8/2006 | James et al. | |
| 2006/0213417 | A1 * | 9/2006 | Codos et al. | 112/475.08 |

FOREIGN PATENT DOCUMENTS

| | | |
|---|---|---|
| EP | 0581744 | 7/1993 |
| EP | 0715012 | 6/1996 |
| EP | 0717137 | 6/1996 |
| EP | 0581744 | 9/1996 |
| EP | 0867552 | 9/1998 |
| JP | 52-148355 | 9/1977 |
| WO | WO 96/36760 | 11/1996 |
| WO | WO00/28124 | 5/2000 |
| WO | WO 00/50683 | 8/2000 |
| WO | WO 00/68481 | 11/2000 |

OTHER PUBLICATIONS

*Legacy 4/2 High Speed Multi-Needle Chainstitch Quilting Machine*, Gribetz International, Global Systems Group, a division of Leggett & Platt, Dec. 2005.

*Reliance M4/2+ High Speed Multi-Needle Chainstitch Quilting Machine*, Gribetz International, Global Systems Group, a division of Leggett & Platt, Dec. 2005.

*Omni-Cutter Programmable Panel Cutter Series*, Gribetz International, Global Systems Group, a division of Leggett & Platt, Mar. 2005.

*Axiom Multi-Head, Dual-Bridge Chainstitch Quilting Machine*, Gribetz International, Global Systems Group, a division of Leggett & Platt, Mar. 2005.

*Quilting Machine: Custom Options*, Gribetz International, Global Systems Group, a division of Leggett & Platt, Mar. 2005.

*Shuttle 1200 Computerized Quilting Machine, High-Speed Lock Stitch Quilting Machine*, Gribetz International, Global Systems Group, a division of Leggett & Platt, Feb. 2003.

* cited by examiner

PANEL QUILTING MACHINE

CROSS-REFERENCE TO RELATED APPLICATIONS

This application claims the benefit of U.S. Provisional Application Ser. No. 60/775,657, filed Feb. 22, 2006, entitled "Panel Quilting Machine," the entire contents of which is hereby incorporated by reference as if presented herein in its entirety.

FIELD OF THE INVENTION

The present invention generally relates to the quilting of fabric materials, and in particular to a system and method of quilting fabric panels that can be slit or cut to form panels, borders, and other components for mattresses and other bedding items.

BACKGROUND OF THE INVENTION

Many mattresses today include borders, top and bottom panels, and other components that are formed with quilted patterns along their surfaces. The quilting of such patterns generally is designed to provide a decorative, aesthetically pleasing appearance to the panels, borders, and other components, as well as to attach together the different layers or plies of materials for the panels. For example, the panels can include top and bottom fabric pieces or layers, with a cushion material, such as foam or other soft, pliable materials sandwiched therebetween, and a backing. As the decorative pattern is stitched or sewn into the panels, the multiple layers or plies of materials are also attached together. The quilted materials then can be fed from the quilting machine in a substantially continuous length into a panel cutting station. The panel cutter can be connected to and operated in conjunction with the quilting machine to cut the quilted materials being fed from the quilting machine into panels of desired lengths, or in some cases, can be used to slit or cut elongated sections or lengths of the quilted materials that can be used to form borders or other mattress components.

The operation of the quilting machines is, however, typically limited by factors such as the thicknesses of the materials being quilted, the patterns being formed, as well as by the mechanical linkage typically utilized between the presser foot and needle bar drive shaft for reciprocating the presser foot and needle bar drive shafts in a directly timed relationship. For example, the presser foot must be raised as the needles are moving out of engagement with the fabric, but after the loopers have caught/picked the loops of thread from the needles, to enable further movement of the fabric, and thus its movement is often tied to the stroke of the needle. The movement of the presser foot must also be of a sufficient stroke and begun/ended at a time to allow materials of varying thicknesses to pass thereunder without binding or bunching. The operation of the quilter also can be limited by the speed at which a panel cutter connected to the quilting machine can be operated. Thus, it may be necessary to substantially slow the operation of the quilting machine, and at times stop the quilting machine, in order to enable the panel cutter sufficient time to cut the panels at the desired length.

In addition, while adjustments are being made to the cutting or slitting blades of the panel cutter, operation of the panel cutter and, if connected in series therewith, the quilting machine generally must be halted. Changing or adjusting the position of the slitting blades of the panel cutter can, however, be a substantially time consuming operation, as the blades typically must be uncoupled from the blade drive shaft along which they are mounted and thereafter shifted with respect to each other to cut the quilted material at the desired spacings, after which the slitting blades must be re-secured to their drive shaft. This adjustment procedure can be a time consuming and somewhat dangerous operation as it typically requires the operator to physically handle and move the slitting blades, which can cut or otherwise injure the operator.

Still further, for sewing various thicknesses of quilted materials, such as when using a thicker foam pad or cushion, it can be necessary to adjust the position of the presser foot of the quilting machine for sewing the different thicknesses of materials. These adjustments typically can require the use of complex electronic position controls or manual adjustment of the individual cams between the presser foot drive shaft and needle bar rocker shaft. Other problems that can limit the operation of such quilting and panel cutting systems include bunching or jamming of the materials being quilted under the presser foot, or one or more layers of the material running out.

Accordingly, it can be seen that a need exists for an improved quilting machine that addresses the foregoing and other related and unrelated problems in the art.

SUMMARY OF THE INVENTION

Briefly described, the present invention generally relates to a system and method for quilting fabric panels such as for use in mattresses, foundation sets, cushions and the like. The system of the present invention generally includes a quilter unit having at least one needle bar driven in a vertically reciprocating motion off of a main drive shaft for the quilter unit, and which has a series of needles mounted in spaced series therealong. The needles carry a series of threads and are reciprocated into and through the fabric material as fabric material is fed through a sewing zone of the quilter unit. The fabric material being fed through the quilter unit generally comprises multiple layers or plies of various woven and non-woven materials, as well as typically including a foam fill or cushioning material. The fabric and cushioning material layers are fed in a multi-ply arrangement from a series of supply rolls into and through the quilting unit. Sensors are positioned upstream from the sewing zone to detect bunching or gathering of the cushioning material or the run-out of one or more of the fabric or cushioning material layers prior to the bunched material or trailing end of the run-out fabric material reaching the sewing zone.

The quilter unit further includes a presser foot that extends transversely across the width of the quilting machine is driven in a vertically reciprocating manner off of the main drive shaft of the quilter unit. Both the presser foot and needle bar are driven off the main drive shaft by separate, adjustable eccentric drive linkages, which enables the presser foot and needle bar to be driven independently of each other. The presser foot and needle bar thus can engage the fabric material plies at different or varying intervals during a sewing operation to ensure that the needles are able to fully penetrate the multiple plies of the fabric material and that the loops of thread formed thereby will not be pulled loose as the needles are withdrawn from the fabric material. The threads are fed to the needles from a series of thread guides through one or more rows of thread breakage detectors. Multiple rows of thread breakage detectors can be provided as needed for enabling different threading sequences to be utilized for quilting multiple patterns in the fabric material. The quilter unit further can be programmed to quilt a variety of different patterns via movement of the fabric material in lateral and longitudinal directions within the sewing zone of the quilter unit.

During quilting operations, the fabric material generally is maintained under a sufficient amount of tension by a tension assembly provided upstream from the sewing zone, to ensure smooth feeding and proper formation of the desired quilted pattern. The tension assembly includes a tension applicator bar or roller about which the fabric material is passed and adjustable guide bars that can be lowered as needed to provide slack for splicing. The amount of tension or force applied also can be adjusted by actuators that can raise the tension bar as needed to reduce the tension force being applied, to reduce the amount of stretch in more elastic materials such as knit fabric materials.

The quilted fabric material can be fed from the quilter unit to a downstream roll or spool for collecting the quilted material for storage, or can be fed to a panel cutter. The panel cutter generally can include a series of slitting blades for cutting lengthwise slits or strips, and a panel cutting blade that can be moved across the width of the quilted material for cutting panels of different lengths. The quilted material is generally fed along a discharge chute, where the quilted material can be fed or wrapped around an accumulator or deposited on a transport, with the quilted material either remaining uncut, slit longitudinally into various width strips, or cut into panels. A series of sensors further generally are provided along the length of the discharge chute for detecting when various lengths of the quilted material have passed thereover for engagement of the panel cutting blade to form panels of desired sizes.

Still further, the longitudinally oriented slitting blades can be adjustably and removeably mounted along their drive shaft via locking collars and locking hubs that can be remotely engaged via a tool so as to unlock and enable lateral movement of the slitting blades along their drive shaft to a desired position or to create a desired spacing between adjacent slitting blades, after which the blades are automatically locked in place. The slitting blades additionally can be formed as sectioned blades, typically formed in two halves or sections that can be brought into mating alignment and locked together by the engagement of clamp sections that engage the blade sections on opposite sides thereof. Such split blades enable quick and easy replacement of damaged slitting blades without having to remove the entire drive shaft and all the blades therealong.

Various objects, features and advantages of the present invention will become apparent to those skilled in the art upon a review of the following Detailed Description, when taken in conjunction with the accompanying drawings.

DETAILED DESCRIPTION OF THE INVENTION

The present invention generally is directed to an improved system 10 and method of quilting fabric textile materials, typically for use as mattress panels, borders, gussets and other components for mattresses and foundation sets. The quilting system 10 of the present invention and various inventive features thereof, are shown in FIGS. 1-5B of the drawings.

Figure 1:
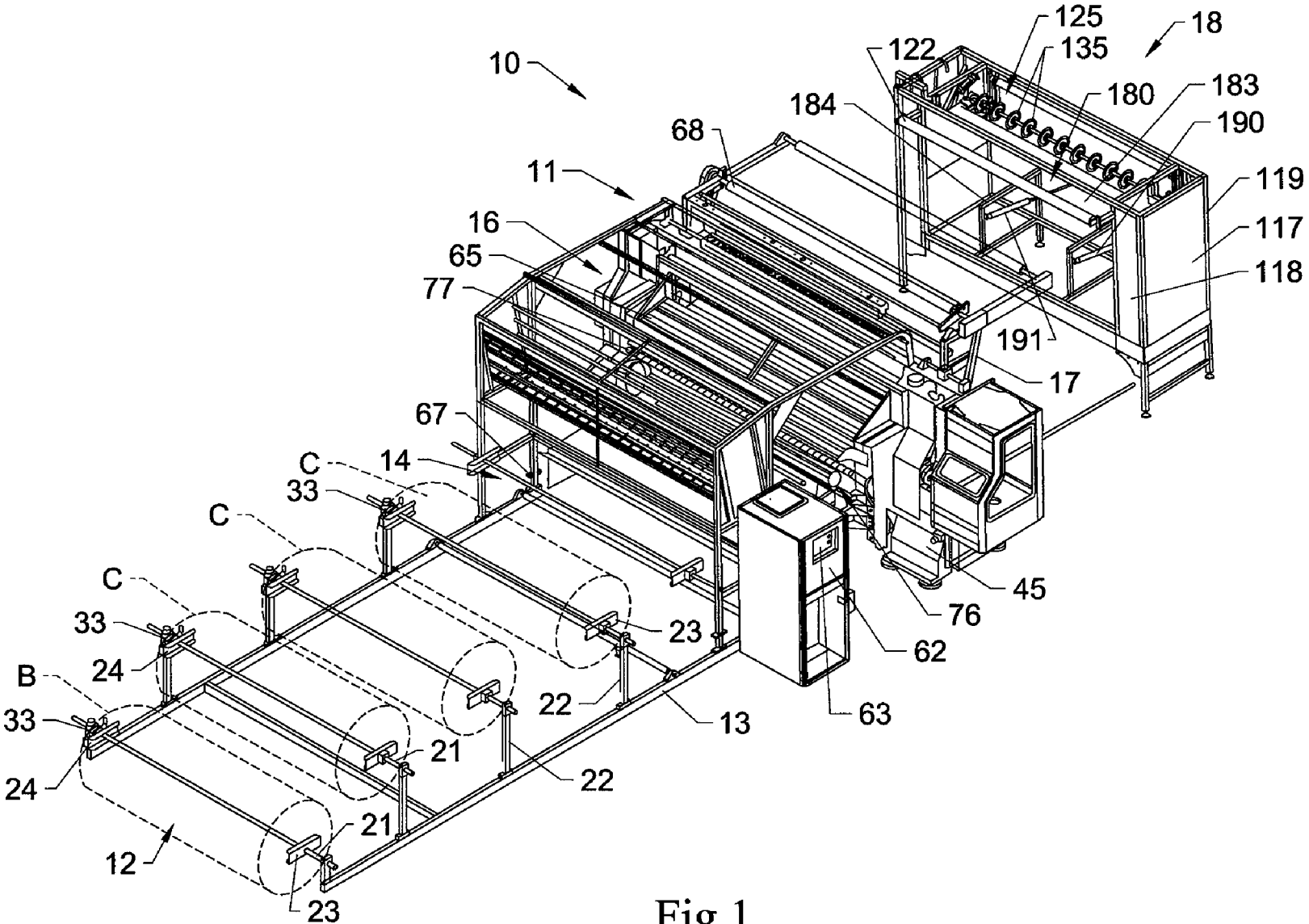
FIG. 1 is a perspective illustration of the system for forming quilted fabric materials according to the principles of the present invention.

As generally indicated in FIG. 1, the quilting system 10 of the present invention will including a quilting machine or quilter unit 11 that receives a series of plies or layers of woven and non-woven fabric or other textile backing materials B, which can include one or more upper and lower plies of an outer facing fabric material, with a foam fill or similar cushioning material layer C being received therebetween. The backing and cushioning materials will be fed from a series of supply rolls 12, typically mounted on a rack 13 positioned upstream from an input or first side 14 of the quilting machine, with the backing and cushioning materials being fed into registration and passed into and through a sewing zone 16 of the quilting machine. The quilting machine 11 thereafter sews a desired or programmed quilted pattern therein, attaching the plies of the backing and cushioning materials together as the backing and cushioning materials are passed therethrough. The resultant quilted material Q (FIG. 3C) then can be fed from the rear or second side 17 of the quilting machine 11 and wound about a roll for storage, or, as indicated in FIG. 1, can be fed to a panel cutter station or panel cutting system 18 in which the quilted material can be cut widthwise to form panels of varying desired lengths or sizes, i.e., for a king, queen, etc., mattress, or alternatively, can be slit lengthwise into one or more sections or strips to form mattress borders or other bedding components.

Figure 2:
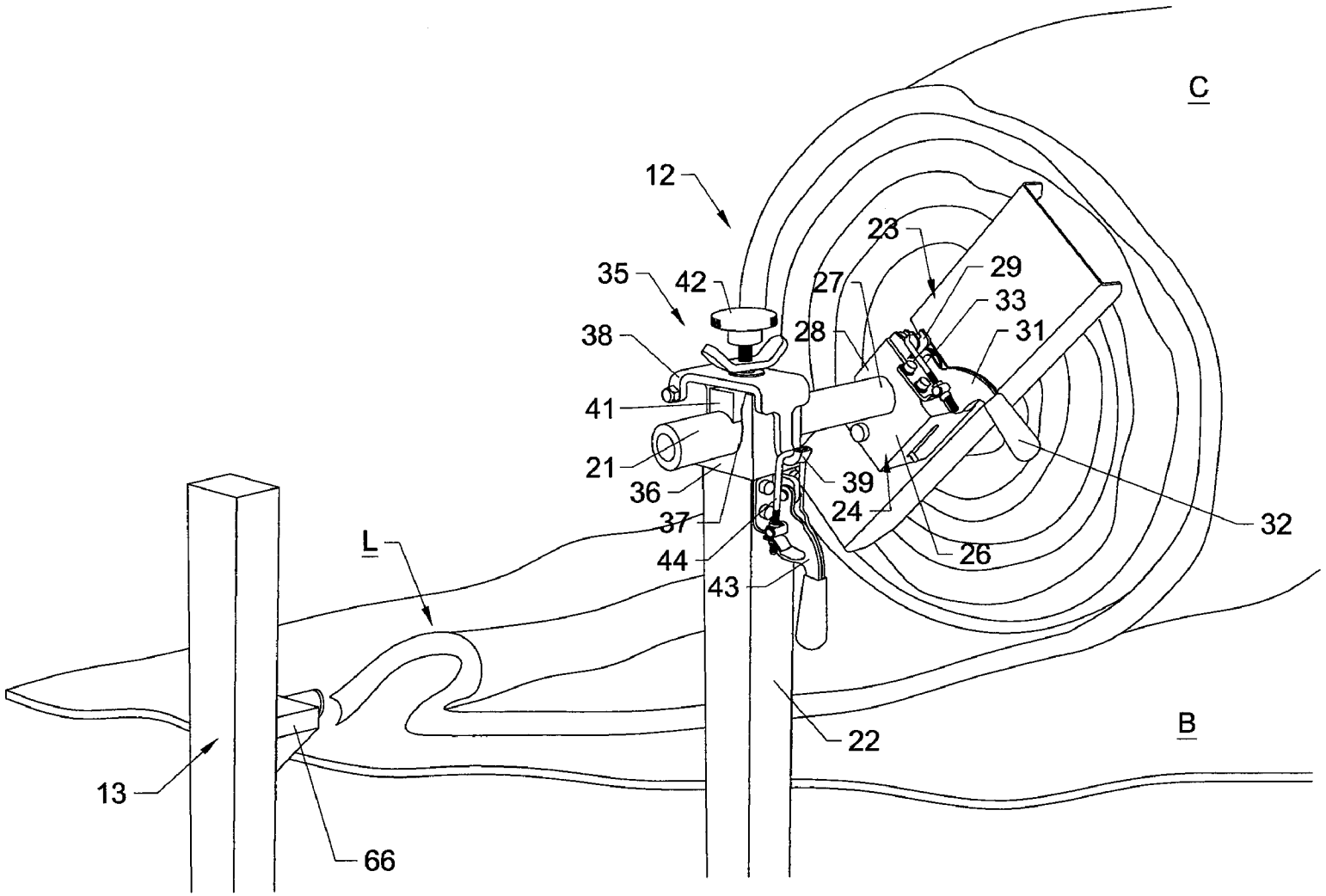
FIG. 2 is a perspective illustration of a quick release clamp mechanism for securing the spools of material on the supply racks upstream from the quilter unit.

As shown in FIGS. 1-2, the supply rolls 12 for the various backing material B and cushioning material plies C each generally are supported along rods or axles 21 that are rotatably mounted on stands or supports 22 of the supply rack 13. The supply rolls are positioned along the rods 21 and are fixed in place by roll clamps 23 that are releasibly secured to the rods 21 by clamp assemblies 24. As illustrated in FIG. 2, each clamp assembly 24 includes a body 26 defining a recess 27 in which the rod 21 is received, and a pivoting support block 28 with a hook shaped clevis 29 attached along an upper end of the body 26. A hand operable pull latch 31, which can include a hand grip 32, is pivotally attached to the body 26 and carries a U-shaped locking member 33 that is engaged by the clevis 29 of the support block 28 to lock the support block 28 in a lowered position and thus secure the supply roll 12 in position along its support rod. Such a construction thus enables quick and easy changeout of the supply roll by enabling an operator to manipulate and lock the clamp assembly 24 in place in a substantially one-handed operation.

As further shown in FIG. 2, the ends of the rods 21 are rotatably secured to their supports 22 by latch assemblies 35. Each latch assembly includes a body 36 mounted to an upper end of a support 22 and defining a recess 37 in which the end of a support rod 21 is received. A latch plate 38 having a hook or clasp 39 is pivotally attached to the body 36 and is moveable to a locking position over the recess 37 as shown in FIG.

2. A clamp block 41, generally formed from a plastic, synthetic or other reduced friction material, also can be positioned along an underside surface of the latch plate 38 and will be moveable into engagement with the end of the rod 21 by engagement of a jack screw 42 or similar mechanism. Additionally, a pull latch 43 is pivotally attached to the body and carries a U-shaped locking member 44 adapted to engage and hold the hook 39 of the latch plate 38 to secure the latch plate in its engaged, locked position with the end of the rod 21 rotatably secured within the latch assembly 34.

As generally indicated in FIGS. 1 and 3A-3C, the quilting machine 11 includes a frame 45 on which the operative components of the quilting machine are mounted and supported, including a main drive shaft 46 that drives one or more elongated needle bars 47 carrying one or more rows of spaced needles 48, a presser foot 51, as well as a series of loopers (not shown) mounted below the needles along the sewing or quilting zone 16. The main drive shaft 46 (FIG. 3A-3B) generally is formed in two sections 46A-46B that extend transversely across the quilting machine 11. A drive motor 52 (FIG. 3A) can be mounted between the ends of the main drive shaft sections for driving each of the main drive shaft sections.

A series of sewing threads T (FIG. 3C) are fed through a series of thread guides 55 to each of the needles 48. The thread guides 55 generally are mounted in spaced rows extending across the width of the quilting machine frame 45 along the rear side 17 thereof. The thread guides receive the threads T from creels or other supplies (not shown) for feeding to the needles. Breakage detectors 56 generally are mounted above the thread guides in a position such that the threads T pass therethrough as the threads are fed to their respective needles. Each of the breakage detectors 56 generally includes a body 57 defining a thread receiving slot 58 along a rear side edge thereof, and further includes a circular opening 59 formed through its body. The openings 59 of each of the breakage detectors 56 are aligned across the width of the quilting machine 11 as indicated in FIG. 3C. Sensors 61 such as a photo-sensor, photoelectric eye, or other, similar detectors, are aligned with the openings 59 of the breakage detectors 56 for detecting when one or more of the detectors has been tripped, i.e., upon its thread breaking, a plate is caused to be moved into a position blocking the opening of the breakage detector. In response, the sensor 61 sends a signal to the control system 62 of the quilting machine for the to alert the operator of the breakage of the threads and for shutting down the quilting machine to enable rethreading of the broken threads.

As additionally indicated in FIG. 3C, multiple rows of breakage detectors 56 generally can be provided for receiving threads from various ones of the thread guides located therethrough in order to enable a wider variety of quilting patterns to be run without requiring repositioning of the breakage detectors in different spacings across the quilting machine to receive the threads from the different thread guides. The sensors 61 also can be mounted on a moveable support to enable the sensors to be moved to different positions or elevations for monitoring the different rows of breakage detectors. Alternatively, multiple sensors can be used, each being aligned with a separate row of the breakage detectors.

The control system 62 of the quilting machine 11 is illustrated in FIG. 1 and generally includes a programmable computer system with a display 63, and which can further include a design center memory in which a variety of quilting patterns can be stored and accessed by the machine operator for forming the different patterns as needed. Additionally, the control system 62 unit further can be linked to a separate design center or networked into a plant control system for providing feedback information as to the operation of the quilting machine and/or for accessing and downloading additional pattern information as needed. The control system 62 monitors and controls the operative elements of the quilting machine, including the control and operation of the drive motor 52 (FIG. 3A) for driving the main drive shaft 46, which in turn drives the needle bars, presser foot and loopers, as well as other operative elements of the quilting machine.

A first pair of drive or feed rolls 65 (FIG. 3A) generally are mounted upstream from the sewing zone 16 of the quilting machine 11. The feed rolls 65 typically include at least one pair of pinch rolls driven by drive motors such as servomotors or other reversible, variable speed motors under control from the control system 62, and engage and pull the backing and cushioning materials from their upstream supply rolls 12 for feeding the fabric material into the sewing zone.

In addition, as the backing and cushioning materials are pulled from their upstream supply rolls 12 by the feed rolls 65, the backing and cushioning materials pass by a lump detector 66 (FIG. 2), as well as one or more run-out detectors 67 (FIG. 1) mounted along the downstream edge of the supply rack 13. The lump detector and/or run-out detectors 66 and 67 can include photoelectric eyes or other similar detectors and positioned facing across the backing and cushioning materials as these materials enter the quilting machine 11. The lump detector 66 (FIG. 2) detects the formation of a lump, bunching or other accumulation L of the cushioning material C that would be too large to pass beneath the presser foot and needle bars of the quilting machine and thus cause an obstruction that could halt the quilting process. The run-out detector(s) 67 (FIG. 1) monitors the various layers of materials to determine when one or more of the backing material layers and/or cushioning material layer have run out and need to be replaced prior to the trailing ends of the run-out layer of backing/cushioning material reaching the sewing zone 16. The lump detector and run-out detectors send a signal back to the control system of the quilting machine upon detection of lumps or other accumulations of cushioning material or the detection of the trailing end of one of the backing or cushioning material layers passing thereby to alert the operator, and/or temporarily halt operation of the quilting machine to enable removal of the accumulation or splicing of a new roll of fabric material.

As further indicated in FIG. 3C, downstream drive or feed rolls 68 further are mounted along the rear side 17 of the quilting machine 11 to assist in pulling and directing the quilted material through the sewing zone and away from the needles along an overhead path to a downstream cutting station 18, or for winding about a storage roll. Both the upstream and downstream feed rolls 65 and 68 (FIG. 3A), respectively, typically are covered with a roughened or tacky surface so as to provide sufficient grip for pulling the backing and cushioning materials, as well the resultant quilted material therebetween without damaging such materials. At least one of the rolls of each of the pairs of upstream and downstream feed rolls further is driven by a drive motor 69, such as a servomotor or other variable speed, reversible motor under control of the control system 62, and further can be provided with load sensors that detect and provide feedback regarding increased load or drag on the feed rollers, which could be indicative of problems such as a jam or accumulation of materials attempting to pass through the sewing zone 16.

Figure 3A:
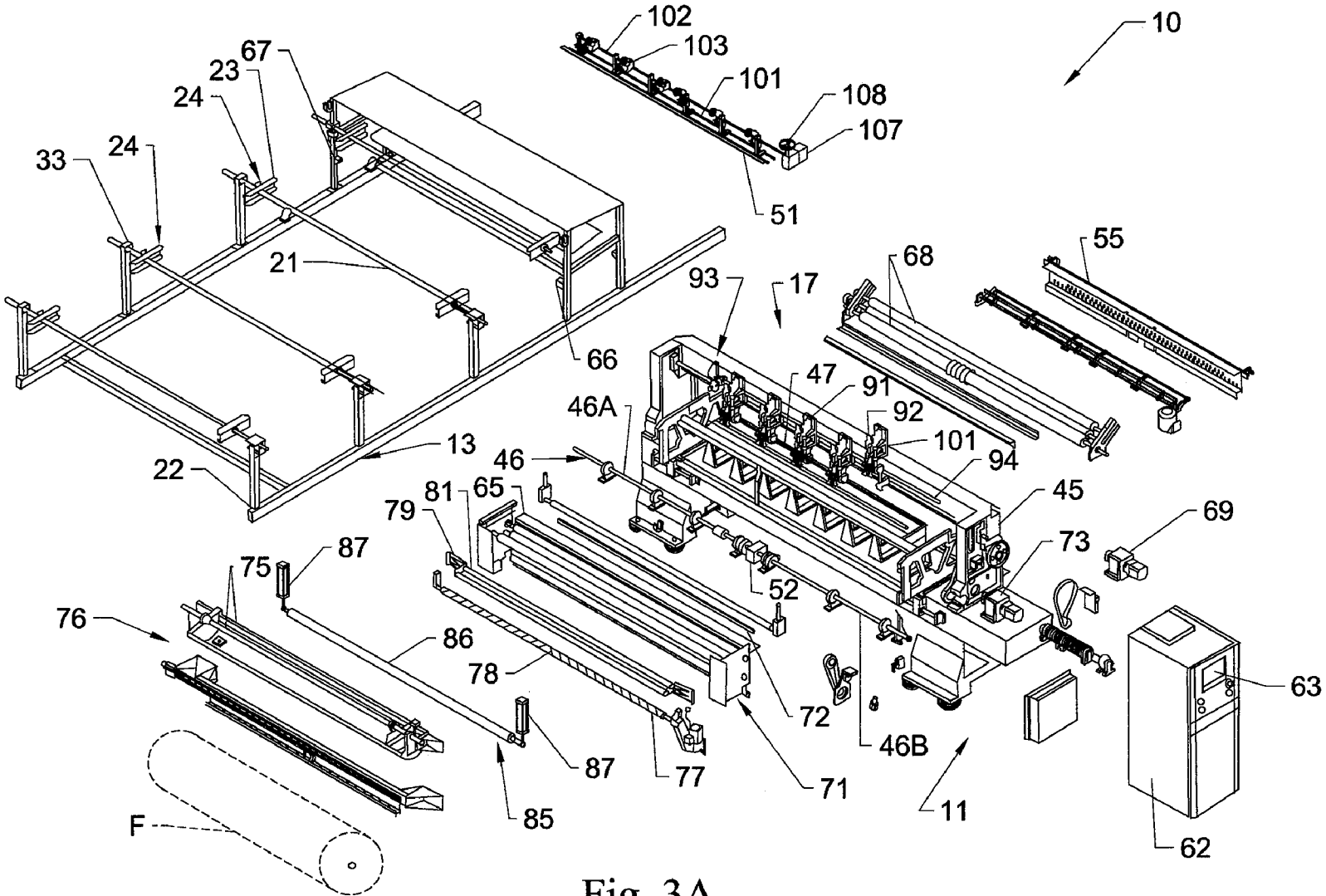
FIG. 3A is an exploded perspective view of the quilter unit.

In addition, as indicated in FIG. 3A, the upstream feed rolls 65 typically are mounted on a carriage or moveable support 71 that is moved laterally back and forth along a guide track 72 across the width of the quilting machine 11 by a variable speed, reversible servomotor or similar drive 73. As a result, the upstream feed rolls, and thus the fabric backing and cushioning materials engaged thereby, can be shifted or moved laterally with respect to the needle as needed according to programmed pattern information under the control of the control system 62, while at the same time, the feed rolls themselves can be driven in forward and reverse directions to provide longitudinal shifting or movement of the backing and cushioning materials with respect to the sewing needles in order to form desired quilting patterns or designs.

Still further, a front tray assembly 75 generally is mounted adjacent the upstream feed rolls 65. The tray assembly is comprised of an elongated trough or tray 76 in which a roll of fabric material F can be received for application to the backing and cushioning materials as these materials are fed into the sewing zone 16. The tray 76 generally includes a run-out sensor or detector mounted along a lower portion thereof that detects when the fabric material F has run out or when the trailing end of the fabric material is exiting the tray 76 and sends a signal to the control system 62 of the quilting machine. As additionally shown in FIGS. 3A-3B, the fabric material also is generally passed over a pleating roll or bar 77, which includes an elongated rod or roller extending transversally across the quilting machine and which has a helical ridge 78 extending thereabout, which ridge 78 that is adapted to engage and remove pleats or wrinkles from the fabric material prior to the fabric material being fed into registration with the other fabric, backing, and cushioning materials layers.

The fabric material further passes around a pair of guide bars 79 that apply a tension or drag to the fabric material, and which are mounted on pivoting supports 81. The pivoting supports 81 enable the guide bars to be pivoted between a raised, operative position and a lowered, non-operative position in which the tension applied to the fabric material F by the guide bars is released so as to provide additional slack as needed for splicing the trailing end of the fabric material F to the leading end of a new roll or supply of fabric material received within the tray assembly 75. When moved to their lowered position, the guide bars can create up to approximately 8-14 inches of additional slack to facilitate splicing of the fabric material as needed.

As further illustrated in FIG. 3A, a tension applicator assembly 85 is positioned below and in front of the upstream feed rolls 65 for applying a tension or drag force to the combined fabric, backing, and cushioning materials prior to the combined fabric, backing, and cushioning material layers F, B, and C, passing through the feed rolls 65 to ensure that there is a consistent amount of stretch applied to the fabric, backing, and cushioning material during a quilting operation. The tension applicator assembly 85 generally includes a dancer bar or tension applicator bar 86, the ends of which are connected to actuators 87 for raising the tension applicator bar as needed to adjust the tension being applied by the tension applicator bar to the combined material layers. Typically, the tension applicator bar can weigh between approximately 30 to 50 pounds and thus will apply a tension force against the material layers by virtue its weight pressing downwardly on the material layers passing thereabout. For more elastic materials such as knit materials that stretch to a larger extent than, for example, non-woven materials, the actuators 87 can be engaged to raise the tension applicator bar as needed to reduce the weight or force pressing down on the fabric, backing, and cushioning material layers, and thus the amount of tension applied thereto. Typically, the actuators 87 are pneumatic or hydraulic actuators that can be connected to a fluid supply such as a supply of pressurized air or other fluid media, and can be varied or controlled by the operator to supply more or less pressure as needed to lift the bar and thus adjust the weight and/or tension force being applied by the bar. Alternatively, other types of actuators, such as reversible motors or the like, also can be used to adjust the weight and thus the force being applied by the tension applicator bar.

Figure 3B:
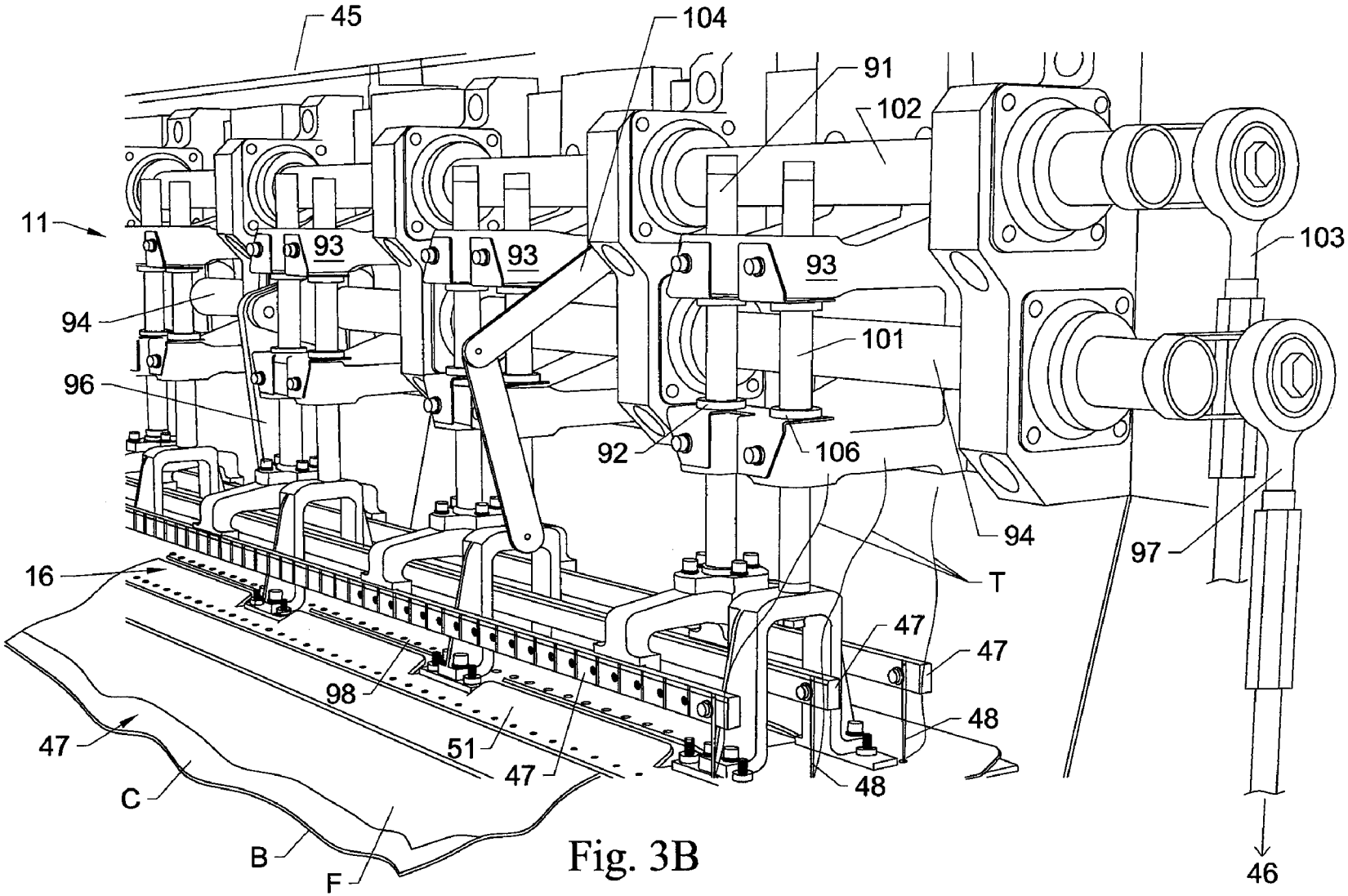
FIG. 3B is a perspective illustration of the presser foot and needle bar drive mechanisms of the quilter unit.
Figure 3C:
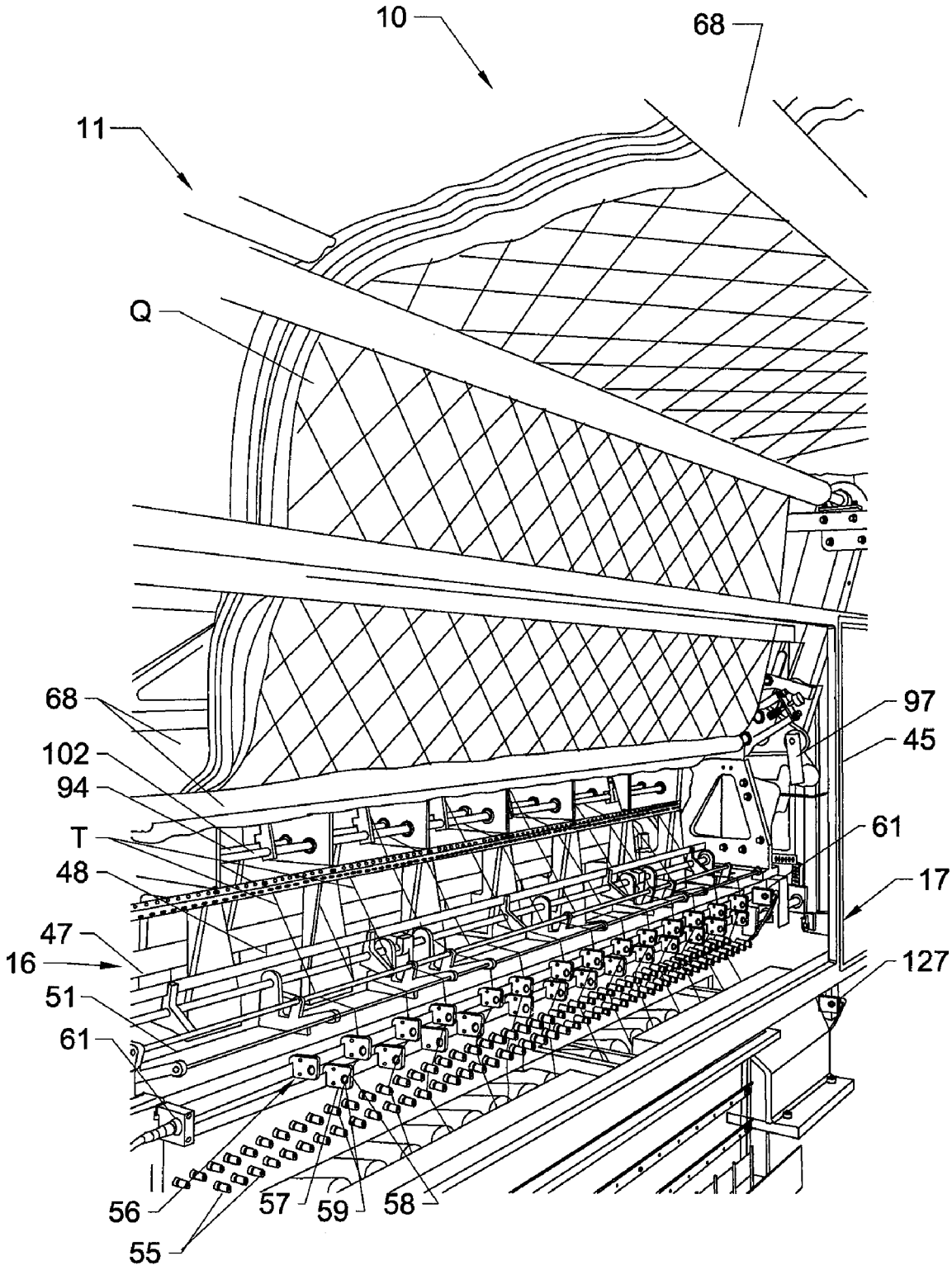
FIG. 3C is a perspective view of the rear side of the quilter unit according to the principles of the present invention.

As indicated in FIGS. 3A-3B, needle bar 47 generally is attached to and carried by a series of vertically extending needle bar supports 91 that extend and move through greaseless/oil-less bushings 92 mounted within guide members 93 attached to the frame 45 of the quilting machine 11. One or more of the needle bar supports 91 are connected to and driven by a needle bar rocker or drive shaft 94 by eccentric connectors or similar linkages 96. The needle bar drive shaft 94 can be driven directly by variable speed servomotor mounted at one end of the quilter unit, or, as illustrated in FIG. 3B can be driven off of the main drive shaft 46 of the quilter unit by adjustable eccentric linkages 97 attached to the ends of the needle bar drive shaft and the ends of each section 46A/46B (FIG. 3A) of the main drive shaft. The eccentric linkages 97 are adjustable so as to enable adjustment or variation in the stroke of the needle bar 47, and thus the needles 48 carried thereby, as needed to form the desired quilted pattern and to assure substantially complete penetration of the needles through the material layers passing thereunder.

The operation of the main drive shaft 46 accordingly drives the needles in a vertically reciprocating motion, with each needle carrying a sewing thread and passing through an aligned opening of a needle plate 98 mounted below the sewing zone. The needles are engaged by corresponding loopers as the needles pass through the needle plate at the bottom of their downward stroke. The loopers pick and pull the threads therefrom for formation of stitches according to the desired quilted pattern to be sewn in the fabric materials. In addition, as the needles are moved through their downward stroke, penetrating the combined fabric, backing, and cushioning material layers, the presser foot 51 similarly is moved downwardly in timed relation with the downward stroke of the needles so as to compress the combined material layers against the needle plate to ensure full and complete penetration of the needles through the material layers.

As illustrated in FIGS. 3A and 3B, the presser foot 51 generally is an elongated plate extending substantially across the width of the quilting machine 11 along the sewing zone 16. The presser foot 51 is moved in a vertically reciprocating motion or stroke by a series of presser foot lift supports 101 connected to and driven by a presser foot rocker or drive shaft 102. The presser foot drive shaft, in similar fashion to the needle bar drive shaft 94, can be driven independently by a variable speed servomotor or similar drive, or as illustrated in the drawing figures, can be driven off of the main drive shaft 46 of the quilting machine independently of the needle bar drive shaft. Adjustable eccentric connectors or linkages 103 generally will be attached to the ends of the presser foot drive shaft 102 and to the ends of the main drive shaft sections 46A/46B (FIGS. 3A-3B) adjacent the eccentric linkages 97 for the needle bar drive shaft 94, for driving the presser foot drive shaft. These eccentric linkages 103 enable adjustment or variation of the stroke or reciprocating motion of the presser foot independently of the operation of the needle bar. As a result, for quilting thicker materials, the stroke or operational cycle of the presser foot can be adjusted so as to cause the presser foot to engage and compress the material layers at an earlier point during the downward stroke of the needles and to maintain this compression of the material layers for a longer period of time as the needle is retracted from the material layers to ensure that the loops of threads formed by the engagement of the loopers with the needles are not pulled free from the material layers by the upward stroke of the needles as these materials expand or decompress as the presser foot is moved out of compressive engagement therewith.

As further illustrated in FIG. 3A, the presser foot driver rocker shaft 102 includes a series of eccentric connectors 104 that connect the presser foot to the presser foot drive shaft 102, while the presser foot lift supports 101 extending downwardly and move through greaseless or oil-less bearings or bushings 106 within the guide members 93 adjacent the greaseless or oil-less bearings 92 for the needle bar supports 91 to guide the reciprocating movement of the presser foot. Additionally, an adjustment mechanism 107 (FIG. 3A) generally is connected to one end of the presser foot drive shaft 102. The adjustment mechanism 107 includes a hand crank 108 or similar drive mechanism that enables the operator to rotate or adjust the pivot points between the eccentric connectors 104 (FIG. 3B) of the presser foot drive shaft 102 and the presser foot 51 so as to adjust the amount or extent of the stroke of the presser foot without requiring additional motors or feedback control loops to control the stroke and position of the presser foot. The top and bottom positions of the presser foot 51 and the timing of its movement between such positions thus can be quickly and easily adjusted to enable sewing of varying thicknesses of the fabric/cushioning materials. For example, for heavier, thicker cushioning materials, the stroke of the presser foot can be adjusted to cause the presser foot to begin its downward movement earlier and to hold its position at the bottom of its downward stroke for a time sufficient to ensure that such materials are compressed sufficiently for sewing, while avoiding interference with the movement of such thicker materials through the sewing zone after lifting of the presser foot.

Figure 4A:
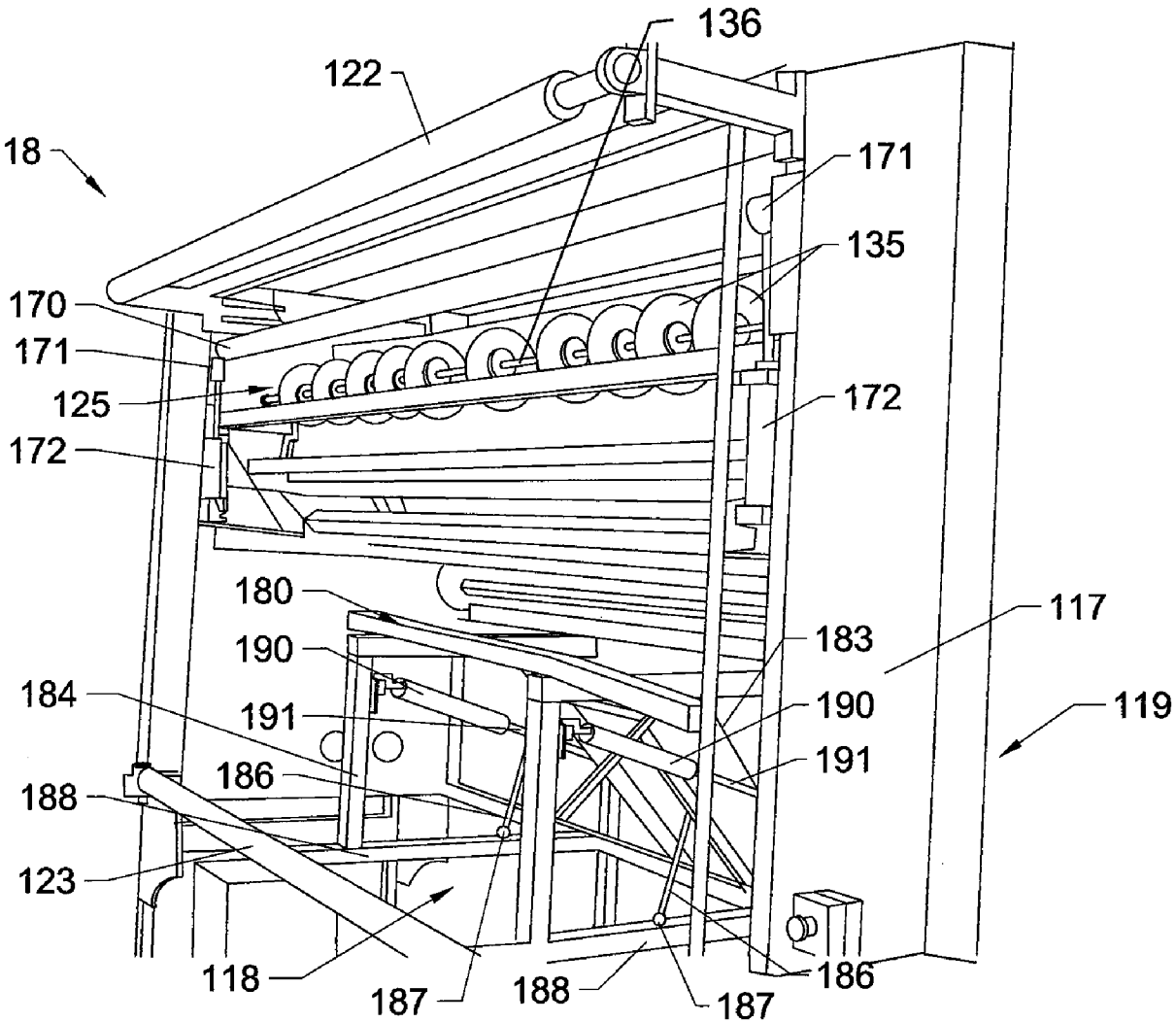
FIG. 4A is a perspective illustration of the front side of the panel cutting system according to the principles of the present invention.
Figure 4B:
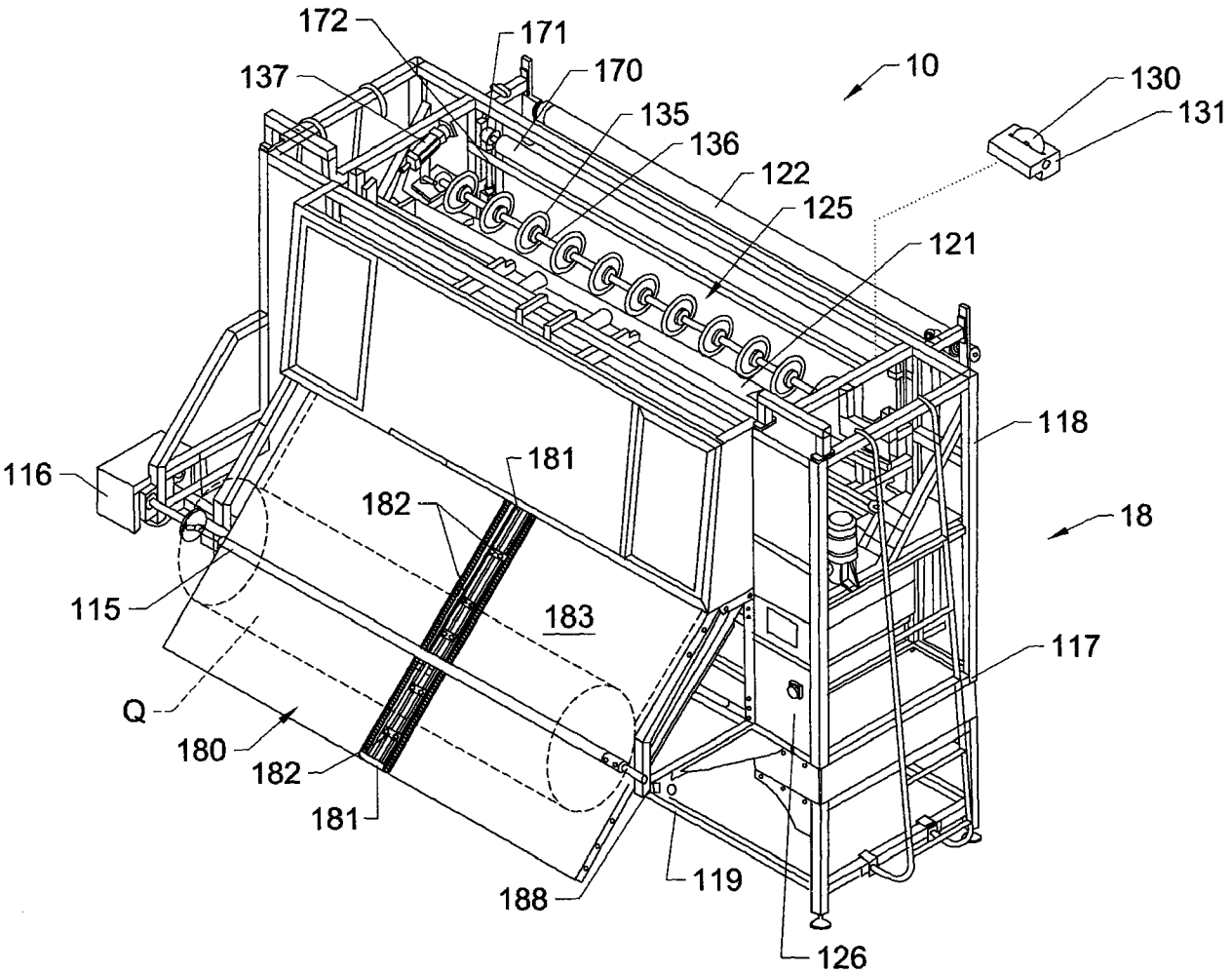
FIG. 4B is a perspective illustration of the rear side of the panel cutting.

As illustrated in FIG. 3C, the quilted fabric materials are drawn out of the quilting machine 11 by the downstream feed rollers 68 and are fed in a generally overhead path away from the rear side 17 of the quilting machine. The quilted material Q (FIG. 3C) thereafter can be collected or wound about a supply or storage roll for later processing. Alternatively, as illustrated in FIGS. 1, 4A and 4B, the quilted material can be fed to a panel cutter or cutting station 18 mounted in series with the quilting machine. As the quilted material is passed through the panel cutting station, the quilted material can be cut into longitudinally extending strips of varying widths, such as for forming borders or similar strip materials for mattresses and foundation sets; it can be cut laterally to form panels of varying lengths and widths such as for forming king, queen, single or double size panels for mattresses; or it can remain uncut and simply be accumulated or wound about an accumulator rod or bar 115 along the rear or downstream side of the panel cutter 18, as indicated in FIG. 4B. The accumulator bar 115 generally can be removably mounted along the rear of the panel cutting station and can be rotated by a drive motor 116 attached at one end thereof to facilitate the winding and accumulation of the quilted material on the accumulator bar.

As illustrated in FIGS. 4A and 4B, panel cutting station 18 generally includes a frame 117 having an upstream side 118 and a downstream side 119. Feed rolls 121 are mounted at an upper portion of the frame along the upstream side thereof and are driven by variable speed reversible motors for receiving and pulling quilted material Q from the quilting machine or other supply in a substantially continuous length. As it enters the panel cutting station, the quilted material being passed about upper and lower idler rolls 122 and 123, and support roller 170, so as to create a loop or supply of the quilted material Q in the panel cutting station for feeding to the cutting elements 125 thereof. The operation of the cutting mechanisms or elements 125 and the feed rolls 121 generally will be controlled by a control system 126 for the panel cutting station. The control system 126 can be operated as a stand alone computer control or can be linked to either the control system 62 (FIG. 1) for the quilting machine 11 or to a network plant control system for control of the cutting and accumulating operations for the panel cutting station. In addition, the drive or feed rolls 121 (FIG. 4B) further typically include roughened or tacky surfaces to provide sufficient grip for pulling the quilted material Q into and through the panel cutting station, while at the same time not damaging the surface of the quilted material as it passes therethrough.

Additionally, a sensor 127 can be mounted to the downstream side of the frame 45 (FIG. 3C) of the quilting machine 11 in a position to monitor and detect the bottom edge of the loop of quilted material being accumulated by the feed rollers prior to cutting in the panel cutting station.

Upon detection of the bottom edge or portion of the loop of accumulated quilted material, a signal is sent to the control system 126 (FIGS. 4A-4B) for the panel cutting station 18 and/or the control system for the quilting machine indicating a slow down or over-accumulation of the quilted material. In response, the operation of the quilting machine can be slowed, either automatically or by the operator, the speed of the panel cutter can be increased as needed, or the entire quilting system 10 (FIG. 1) can be shut down if a more serious fault is detected.

The cutting elements 125 (FIGS. 4A-4B) of the panel cutting station 18 generally include a laterally moving panel cutting blade 130 that is mounted on a moveable carriage 131 for moving the panel cutting blade 130 laterally back and forth across the width of the panel cutting station in order to cut the quilted material into panels of varying desired lengths. The cutting elements 125 also can include a series of longitudinally oriented slitting blades 135 mounted at spaced intervals along the length of a transversely extending drive shaft 136. A drive motor 137 generally is connected to at least one end of the drive shaft 136 for causing rotation of the slitting blades 135 during slitting operations for cutting or slitting the quilted material longitudinally into strips of desired widths according to the spacing between each of the slitting blades mounted along the drive shaft 136.

Figure 5A:
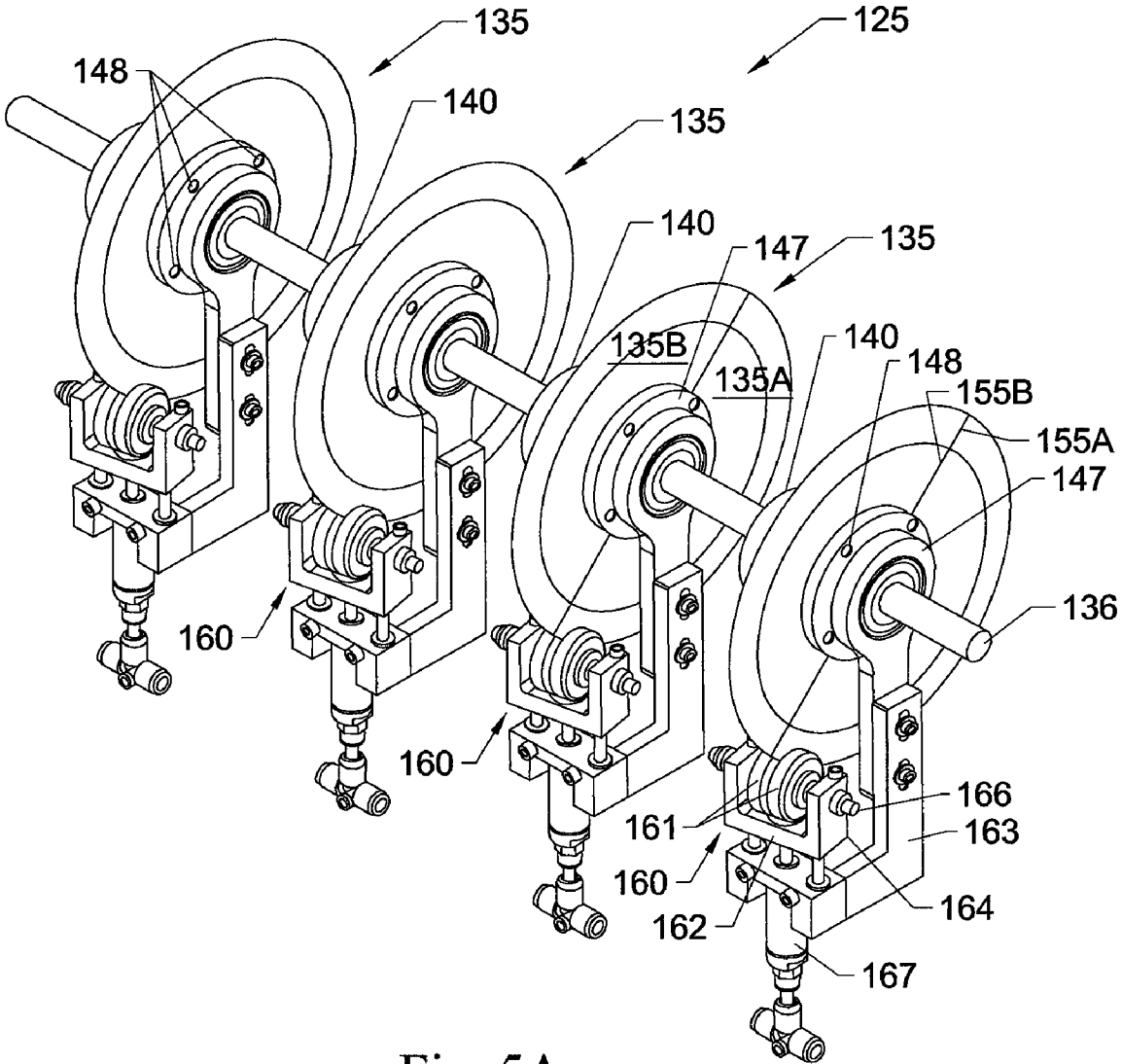
FIG. 5A is a perspective illustration of the slitting blade assemblies of the panel cutting system.
Figure 5B:
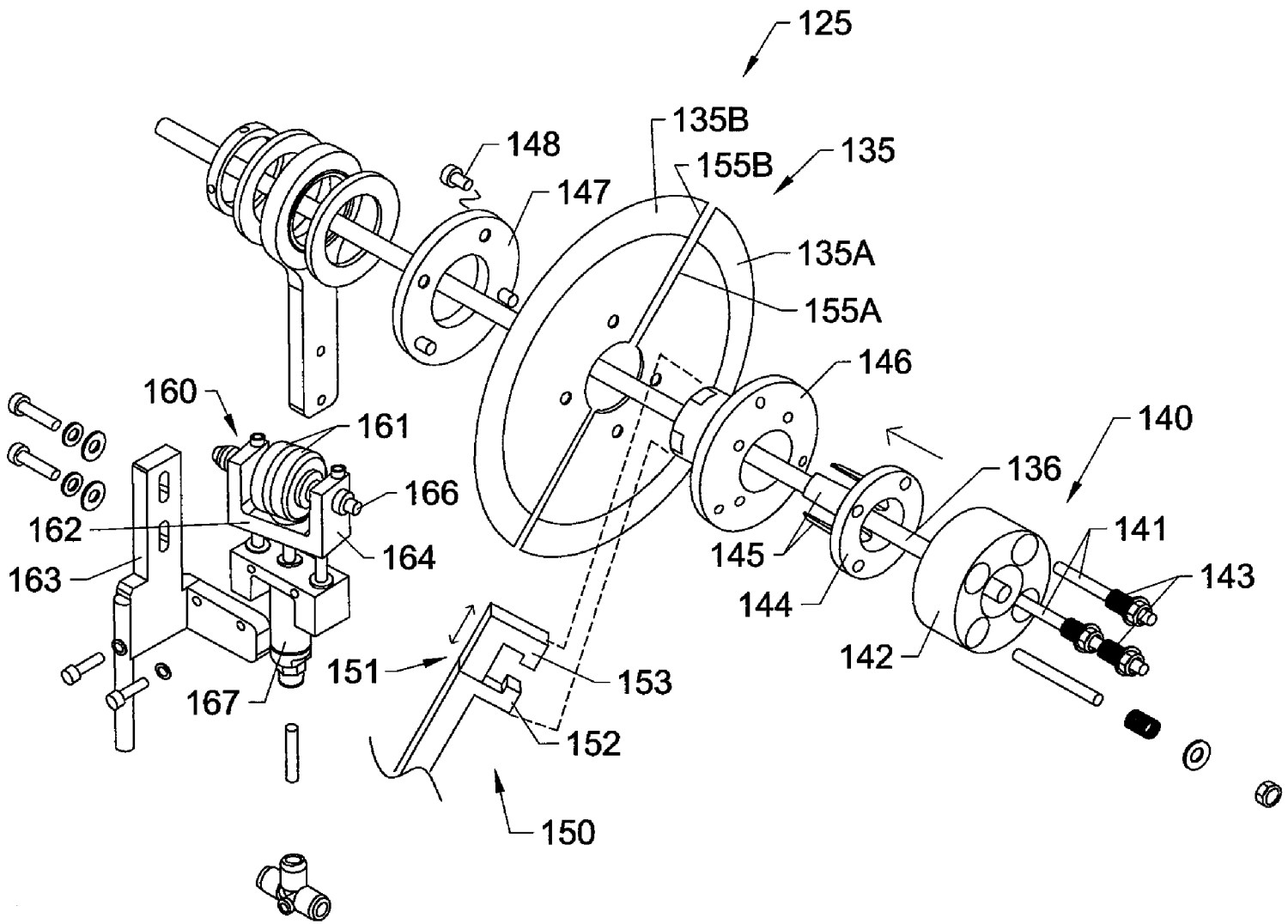
FIG. 5B is an exploded perspective view of one of the slitting blade assemblies of FIG. 5A.

As shown in FIGS. 5A and 5B, the slitting blades generally are realeasably mounted along their drive shaft by spring biased locking collars 140. As indicated in FIG. 5B, the spring biased locking collars 140 generally include a series of locking pins 141 extending through a collar body 142 and which include compression springs 143 positioned therealong. The compression springs urge and force a locking plate 144 having a series of fingers or projections 145 against the drive shaft and a first locking hub section 146 of a pair of first and second locking hub sections 146 and 147 between which each slitting blade is mounted, and which releasably engage and clamp their slitting blades to the drive shaft 136 so as to affix the slitting blades in desired positions or at desired spacings along the drive shaft 136.

Figure 6:
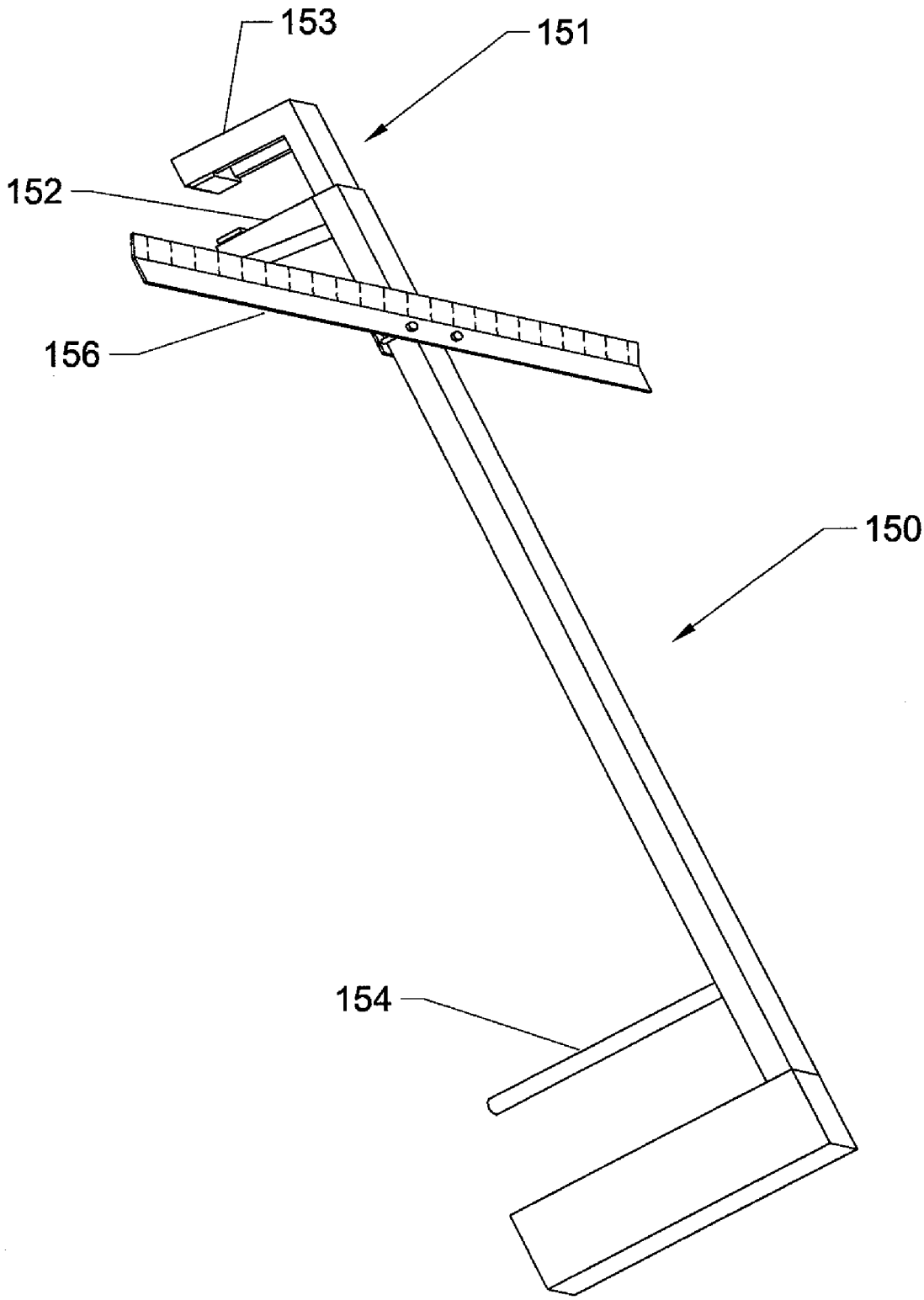
FIG. 6 is a perspective illustration of the remote adjusting tool for adjusting the position of the slitting blade assemblies of FIG. 5A.

The spring biased locking hub 146 and locking plate 144 further can be engaged remotely via a hand operable tool 150 (FIGS. 5B and 6) that can engage the locking collars and locking plate as indicated in FIG. 5B so as to temporarily release the biased locking engagement of the locking collars and locking plate of each of the slitting blades provided by the compression springs 143 (FIG. 5B) to enable sliding movement of the slitting blades 135 along their drive shafts 136. As shown in FIG. 6, the engagement tool 150 generally includes an elongated body having a substantially C-shaped clamping head 151 with a lower jaw 152 and an upper jaw 153 that is generally moved into a compressive, clamped engagement with a locking collar upon engagement or actuation of a trigger or hand grip 154 at the other end of the engagement tool 150 by an operator. The tool further can include a guide or scale 156 having a series of distinct measurements or notations therealong to enable an operator or user to set the spacing between adjacent slitting blades at desired intervals, for example, at 6-12 inches, although other, greater or lesser intervals also can be used.

Still further, it is also possible to use a separate, hand-held guide having projections or sections of different desired spacing for different border sizes, which guide can be inserted between adjacent slitting blades and one or more of the adjacent slitting blades moved into contact therewith by the tool 150 so as to ensure substantially consistent and accurate spacing or positioning of the slitting blades with respect to one another. As a result, the width of the spacings between the slitting blades can be quickly and easily adjusted to form borders or strips of quilted material of different widths or sizes, without requiring an operator to manually reach through the frame and uncouple the slitting blades from their locked position along their drive shaft and thereafter move the slitting blades to a desired position and then recouple them in a locked position by hand. Instead, the slitting blades in the present invention can be quickly and easily disengaged and moved to a desired spacing, after which the locking collars are automatically reengaged. This operation of unlocking of the collars, moving of the slitting blades, and relocking of the collars all can be done remotely with minimal downtime for the panel cutting station and without the need of the operator to physically touch the slitting blades. This further minimizes the potential for injuries to the operator resulting from their having to manually manipulate the slitting blades.

As additionally shown in FIGS. 5A and 5B, the slitting blades 135 can be formed as a single blade, as shown in FIG. 5A, or can be formed in sections or halves 135A, 135B. In the event that a slitting blade becomes nicked, broken or is otherwise unable to be used, the present invention provides for the use of split blades, typically formed in two sections 135A/135B, to enable rapid replacement of the slitting blades without having to shut down the entire panel cutting station 18 and removal of the drive shaft 136 and one or more additional slitting blades 135 therealong in order to replace a single damaged slitting blade. As indicated in FIG. 5B, with the present invention, slitting blade sections 135A and 135B can be brought into mating engagement along common edges 155A and 155B, and thereafter are held in their engaged, mating position by the mating locking hub sections 146 and 147, which are secured together by fasteners 148 with the slitting blade sections in tight, clamped engagement therebetween. In addition, the mating edges 155A and 155B of the slitting blades can be formed in a tongue and groove or other mating configuration in which one of the mating edges engages or is inserted into the opposite mating edge to facilitate and provide a stronger connection between the mating edges. Such a construction thus enables the quick and easy replacement of broken or damaged slitting blades so as to further minimize downtime of the panel cutting station.

Still further, as also illustrated in FIGS. 5A and 5B, automatic sharpeners 160 generally are mounted below the slitting blades 135 and are moveable into a position to engage and automatically sharpen the slitting blades 135 upon activation by the control system 126 of the panel cutting station. The automatic sharpeners 160 each typically include one or a pair of sharpening stones 161 or other similar sharpening elements, that can be brought into engagement with the cutting edge of their respective slitting blade 135 as the slitting blade continues to be rotated to thus automatically sharpen the cutting edge of the slitting blade. Each of the sharpening elements 161 is mounted on a support bracket 162 that is typically attached to a support arm 163 connected to one of the locking hub sections, such as 147, for each slitting blade to help position the automatic sharpeners for engaging the slitting blades. Each support bracket 162, as shown in FIGS. 5A-5B, generally is substantially U-shaped, with the sharpening elements 161 rotatably supported between the arms 164 of the bracket 162 on an axle or pin 166. An actuator 167, such as a pneumatic or hydraulic cylinder (FIG. 5A) is mounted to the support arm 163 and can be engaged by the control system of the panel cutting station to raise the sharpening elements to an engaging position as needed for automatically sharpening the slitting blades. Thus, the need for an operator to further manually handle or manipulate the slitting blades for sharpening the blades is minimized.

As additionally shown in FIGS. 4A-4B, a support roller 170 is generally mounted along frame 117 of the panel cutting station 18, upstream from the slitting blades 135, with the ends of this support roller 170 being attached to and supported by pivoting frame supports or brackets 171. At least one actuator 172, such as a pneumatic or hydraulic cylinder, is attached to one of the supports 171 for pivoting the supports, and thus the support roller 170 between a raised, engaging position and a lowered non-engaging position. The support roller can be raised and lowered by the actuator(s) 172 in order to adjust the height at which the quilted material Q is being fed through the panel cutting station to enable the quilted material to pass over or to be engaged by the slitting blades as needed. For example, as the support roller is raised to its fully extended, engaging position, it will tend to guide the quilted material along a path that extends over and out of engagement with the slitting blades 135, while in its lowered, non-engaging position, the quilted material Q generally will be carried along a path that passes into engagement with the slitting blades for cutting of the quilted material into segments or strips of the desired widths.

Typically, as quilted material exits the panel cutting station 18, it will be fed along the length of a discharge chute 180, as indicated in FIG. 4B, and will be moved into a discharge or receiving position for supporting the quilted material during cutting or can be accumulated on the accumulator bar 115 as needed. The discharge chute 180 also can include a central slot 181 having a series of sensors 182, such as photocells, proximity sensors, and other similar detectors mounted therealong. As the quilted material covers various ones of the sensors 182 mounted along the central slot 181 of the discharge chute, a signal can be sent by such sensors to the panel cutting station system control 126 to signal the halting of the further feeding of the quilted material through the panel cutting station, followed by activation of the movable panel cutting blade 130. Thus, as a desired length of quilted material is passed through the panel cutter, the feed rolls 121 can be stopped and the panel cutting blade 130 engaged to cut the quilted material at a desired length as needed to form a panel of a prescribed size, such as for a king, queen, double, or other size mattress and foundation set. For example, when a sensor corresponding to the feeding of a length of material sufficient to form a king size mattress detects the presence of the quilted material, it will signal the system control for the panel cutting station to stop further feeding of the quilted material and activate the panel cutting blade.

As further indicated in FIGS. 4A-4B, the discharge chute 180 can be moved between various raised support positions for supporting the various lengths of quilted material during cutting of the panels or strips, and thereafter can be lowered to a retracted position as needed, such as when the quilted material is being wound about the accumulator bar 115 for storage and inventory, rather than being cut immediately into panels, borders, or other bedding components by the panel cutting station 18. As shown in FIGS. 4A and 4B, the discharge chute 180 includes a substantially smooth, upper support surface 183 that mounted on a support frame 184, which frame itself is pivotally mounted on pivoting support rods 186 (FIG. 4A) having rollers 187 that engage and roll along support beams 188 of the frame 117 of the panel cutting station 18 as the discharge chute is moved between its raised and lowered positions.

Actuators 190 (FIG. 4A) such as hydraulic or pneumatic cylinders, motors, or other, similar drive mechanisms are attached to the pivoting support rods 186 of the discharge chute frame 184. As the cylinder rods 191 of the actuators 190 are extended and retracted, the support rods accordingly are moved forwardly and rearwardly, rolling along support beams 188 so as to allow the discharge chute to be raised and lowered. The joints within the support rods of the discharge chute frame further can include spring locks that will engage once the discharge chute 180 has been moved to one or more of its raised support positions, such that even if the actuators become disconnected or lose pressure, the support rods 186 will remain fixed in place to prevent the discharge chute from collapsing or falling back to its lowered position. In addition, the actuators further can include an over-center linkage such that when the discharge chute has been raised or lowered to its fully engaged supporting portion or to fully retracted position, if the power/air to the actuators is shut off, the discharge chute automatically will be locked in place to prevent inadvertent movement.

In operation of the panel quilting system 10 (FIG. 1) of the present invention, layers or plies of backing materials B and a cushioning or foam fill material C are fed along a path of travel from support rods 21 mounted on a material rack 13 into a panel quilting machine 11. As the backing and cushioning materials are fed into the panel quilting machine, they pass by a lump detector 66 (FIG. 2), which looks for an detects an accumulation or lump in the cushioning material that could potentially cause jamming of the fabric, backing, and cushioning materials as they pass through the sewing zone 16 of the quilting machine. Additionally, one or more run-out detectors 67 (FIG. 1) are positioned so as to detect the trailing end of one or more of the backing and/or cushioning material layers as they pass thereby. The run-out detector(s) will send a signal to the machine control system 62 to alert the operator of a run-out of one of the backing material layers and/or the cushioning material layer so that the operator can splice additional backing material to the trailing end of the run-out backing and/or cushioning material as needed.

As indicated in FIG. 3A, as the backing and cushioning materials are fed into the quilting machine, an additional fabric material layer is applied thereto, and the combined fabric, backing, and cushioning material layers are passed about a tension applicator bar 86 that creates and maintains a desired tension on the combined material layers as they are fed into the sewing zone 16 of the quilting machine 11 to ensure substantially consistent quilting of a desired pattern therein. The tension applied to the combined material layers by the tension applicator bar can be varied, depending upon the materials being quilted so as to adjust the amount of stretch created in the materials as they are fed into the sewing zone. To adjust the amount of tension applied the operator typically will adjust the pressure in actuators 87 to lift the tension applicator bar 86 and adjust the tension force being applied to the combined material layers as needed to accommodate materials, such as knit materials, having a greater amount of inherent stretch or elasticity.

The fabric, backing, and cushioning material layers F, B, and C are fed by feed rolls 65 (FIG. 3A) into the sewing zone 16 where a series of needles sew a desired quilted pattern within the fabric materials. During a sewing operation, the carriage 71 for the feed rolls 65 can be shifted or moved laterally, while at the same time the upstream feed roll can be operated in forward or reverse directions as needed to move the material layers laterally (side to side) and longitudinally (back and forth) beneath the needles to form the desired quilted pattern therein. As the decorative quilted patterns are sewn in the fabric materials, the material layers further are attached together. Additionally, as the needles are moved along a downward stroke so as to penetrate the material layers, the material layers further are engaged and compressed by a presser foot 51 that is moved in timed relation with the stroke or cycle of the needles.

The operational cycles or strokes of the presser foot and needle bars, respectively, of the quilting machine 11 are driven independently of each other based on the rotation of the main drive shaft of the quilting machine. These operational cycles can be varied by adjustment of the adjustable eccentric linkages 97 and 103 (FIG. 3B) for the needle bars 47, and the presser foot 51. As a result, depending upon the materials being sewn, the operation of the presser foot can be adjusted to ensure that it will provide sufficient compression of the combined fabric, backing, and cushioning material layers as the needles penetrate the material layers and the threads carried by the needles are picked and pulled from the needles by the loopers below the sewing area, and thereafter the presser foot will remain in compressive engagement with the material layers for a time sufficient to ensure that the loops of threads are not pulled free from the material layers with the upward stroke of the needles and the decompression of the fabric and cushioning materials upon lifting of the presser foot. The presser foot then will be raised to a sufficient height to enable varying thicknesses of the material layers to be passed thereunder.

The resulting quilted material will be fed from the quilting machine either to an accumulator, such as a supply roll about which the quilted material can be wound for removal and storage, or can be fed to a downstream panel cutting station 18 (FIG. 1) where the quilted material can be cut into panels or strips of different widths as needed to form borders and other, similar fabric articles. If the quilted material is to be cut into panels, it is fed along a discharge chute 180 and passes over a series of sensors 182, which detect when the leading edge of the quilting material has passed thereover, indicative of the passage of an amount of quilted material sufficient to form a desired size panel (i.e., king, queen, double, or other mattress size). In response, the control system of the panel cutting station can engage a panel cutting blade 130 (FIG. 4B) to cut the quilted material at the desired panel length. Additionally, the panel cutting station can include a series of slitting blades 135 for cutting the quilted material into lengths or strips of desired widths. A support roller 170 generally will be moved to a non-engaging or lowered position so as to lower the quilted material into a position to be engaged by the slitting blades for cutting it into strips. Thereafter, the slit or cut quilted material can be accumulated along an accumulator bar or roll at the rear of the panel cutting station. In addition, the quilted material further can be run through the panel cutting station and remain uncut and simply wound on an accumulator bar 115.

It will be understood by those skilled in the art that while the invention has been discussed above with reference to preferred embodiments, various changes, modifications and additions can be made thereto without departing from the spirit and scope of the invention as set forth in the following claims.

What is claimed is:

1. A system for quilting fabric panels, comprising:

a quilter unit defining a sewing zone through which a fabric material is passed and having a main drive shaft, a needle bar along which a plurality of needles are mounted in spaced series for quilting a desired pattern in the fabric material passing thereunder, a presser foot driven in timed relationship with said needle bar, and a tension control assembly for maintaining the fabric material under a prescribed tension as it passes through said sewing zone;

wherein said needle bar and said presser foot each are independently driven off said main drive shaft of said quilter unit such that said presser foot can be driven at varying rates with respect to said needle bar as needed for quilting fabric materials of varied thicknesses a supply of fabric material to be quilted located upstream from said quilter unit and from which the fabric material is fed to said quilter unit;

a tension control assembly comprising a weighted tension bar about which the fabric material is passed for applying tension thereto and at least one actuator connected to said tension bar for adjusting the tension applied to the fabric material by said tension bar as needed to reduce stretch in the fabric material; and a panel cutter positioned downstream from said quilter unit and having a cutting mechanism for cutting the fabric material into strips or panels of a desired size.

2. The system of claim 1 and wherein said needle bar and said presser foot each include a drive mechanism comprising a drive shaft, at least one support rod connected to each drive shaft and driven in a vertically reciprocating motion for moving said presser foot and said needle bar through a sewing cycle, and an adjustable eccentric drive linkage attached at one end to said main drive shaft and at an opposite end to said drive shafts of each of said presser foot and said needle bar to enable said needle bar and said presser foot to be driven at varying rates.

3. The system of claim 2 and further comprising oil-less bushings through which said support rods of said drive mechanisms of said needle bar and presser foot are received and move during a quilting operation.

4. The system of claim 1 and wherein said at least one actuator comprises a pneumatic or hydraulic cylinder adapted to lift said tension bar by prescribed amounts as needed to reduce the tension applied to the fabric material.

5. The system of claim 1 and wherein said cutting mechanism of said panel cutter comprises at least one slitting blade having a pair of mating sections mounted along a transversely extending drive shaft, and a biased locking collar adapted to releasably engage and hold said cutting blade in a desired position along said drive shaft.

6. The system of claim 5 and further comprising a locking tool having an elongated body with a gripping head at a first end of said body adapted to remotely disengage said locking collars to enable movement of said cutting blades along said drive shaft, and an actuating handle at an opposite end of said body.

7. The system of claim 1 and wherein said cutting mechanism comprises a panel cutting blade mounted on a carriage so as to be moveable across the fabric material for cutting the fabric material into panels.

8. The system of claim 1 and further comprising a series of thread guides feeding threads to said needles and at least two rows of thread breakage detectors mounted at different heights and through which selected ones of the threads are passed for quilting different patterns in the fabric material.

9. The system of claim 1 and further comprising a lump detector mounted upstream from said sewing zone to detect an accumulation of material prior to such accumulation of material entering said sewing zone.

10. A system for quilting fabric panels, comprising:

a quilter unit defining a sewing zone through which a fabric material is passed and having a main drive shaft, a needle bar along which a plurality of needles are mounted in spaced series for quilting a desired pattern in the fabric material passing thereunder, a presser foot driven in timed relationship with said needle bar, and a tension control assembly for maintaining the fabric material under a prescribed tension as it passes through said sewing zone;

wherein said needle bar and said presser foot each are independently driven off said main drive shaft of said quilter unit such that said presser foot can be driven at varying rates with respect to said needle bar as needed for quilting fabric materials of varied thicknesses;

a supply of fabric material to be quilted located upstream from said quilter unit and from which the fabric material is fed to said quilter unit;

a panel cutter positioned downstream from said quilter unit and having a cutting mechanism for cutting the fabric material into strips or panels of a desired size; and wherein said supply of the fabric material comprises at least one roll of fabric material mounted on a support rod rotatably secured on a material rack, and releasable roll clamp adapted to be received and locked in frictional engagement along said rod to enable replacement and repositioning of the roll of fabric material along said rod.

11. A system for quilting fabric panels, comprising:

a quilter unit defining a sewing zone through which a fabric material is passed and having a main drive shaft, a needle bar along which a plurality of needles are mounted in spaced series for quilting a desired pattern in the fabric material passing thereunder, a presser foot driven in timed relationship with said needle bar, and a tension control assembly for maintaining the fabric material under a prescribed tension as it passes through said sewing zone;

wherein said needle bar and said presser foot each are independently driven off said main drive shaft of said quilter unit such that said presser foot can be driven at varying rates with respect to said needle bar as needed for quilting fabric materials of varied thicknesses;

a supply of fabric material to be quilted located upstream from said quilter unit and from which the fabric material is fed to said quilter unit; and a panel cutter positioned downstream from said quilter unit and having a cutting mechanism for cutting the fabric material into strips or panels of a desired size, said panel cutter further comprising a discharge chute moveable between a raised, engaging position and a lowered, non-engaging position.

12. The system of claim 11 and further comprising sensors positioned along said discharge chute for detecting passage of various varying lengths of the fabric material thereover, in response to which said cutting mechanism can be engaged for cutting the fabric material into panels of desired lengths.

13. A quilting machine for forming quilted patterns in a fabric material moving along a sewing path through the quilting machine, comprising:

a frame;

at least a first pair of feed rolls for feeding the fabric material through a sewing zone and a carriage on which said feed rolls are mounted, said carriage being moveable in a direction transverse to the sewing path of the fabric material;

a needle bar carrying a series of spaced needles for inserting threads in the fabric material to form the quilted patterns;

a presser foot moveable into engagement with the fabric material in timed relationship with the insertion of the threads into the fabric materials by said needles; and wherein said needle bar and said presser foot are reciprocally driven off of a main drive shaft for the quilting machine by adjustable, independent drive mechanisms, each comprising a drive shaft, a series of lift supports, respectively, and separate adjustable eccentric linkages connecting said drive shafts of said needle bar and presser foot drive mechanisms for driving said drive shafts of said needle bar and said presser foot independently of each other in response to rotation of said main drive shaft.

14. The quilting machine of claim 13 and wherein said a tension control assembly comprises a weighted tension bar about which the fabric material is passed for applying tension thereto, and at least one actuator connected to said tension bar for adjusting the tension applied to the fabric material by said tension bar as needed to reduce stretch in the fabric material.

15. The quilting machine of claim 14 and wherein said at least one actuator comprises a pneumatic or hydraulic cylinder adapted to lift said tension bar by prescribed amounts as needed to reduce the tension applied to the fabric material.

16. The system of claim 13 and further comprising a lump detector mounted upstream from said sewing zone to detect an accumulation of material prior to such accumulation of material entering said sewing zone.

17. The system of claim 13 and further comprising a series of thread guides feeding threads to said needles and at least two rows of thread breakage detectors mounted at different heights and through which selected ones of the threads are passed for quilting different patterns in the fabric material.

18. A panel cutting system for cutting fabric materials to form panels, strips of materials of various widths and other fabric articles, comprising:

a frame;

feed rolls for feeding the fabric material through the panel cutting system;

a cutting mechanism adapted to engage and cut the fabric material passing through the panel cutting system;

a support roller positioned adjacent said cutting mechanism and moveable between a raised, engaging position to maintain the fabric material into a position out of engagement with said cutting mechanism, and a lowered, non-engaging position, whereby the fabric material can be cut by said cutting mechanism; and a control system for controlling operation of said feed rolls, cutting mechanism, and said feed control roller.

19. The panel cutting station of claim 18 and wherein said cutting mechanism comprises a plurality of slitting blades mounted in spaced series along a drive shaft.

20. The panel cutting system of claim 19 and wherein at least one of said slitting blades comprises a split blade having mating sections held in mating engagement by locking hubs positioned on opposite sides of said mating sections.

21. The panel cutting system of claim 19 and wherein said slitting blades further include spring biased locking collars biased into engagement with said slitting blades and said drive shaft for fixing said slitting blades into a desired position along said drive shaft.

22. The panel cutting system of claim 21 and further comprising a locking tool having an elongated body with a gripping head at a first end of said body adapted to remotely disengage said locking collars to enable movement of said cutting blades along said drive shaft, and an actuating handle at an opposite end of said body.

23. The panel cutting system of claim 18 and wherein said cutting mechanism comprises a panel cutting blade mounted on a carriage so as to be moveable across the fabric material for cutting the fabric material into panels.

24. The panel cutting system of claim 18 and wherein said panel cutter comprises a discharge chute moveable between a raised, engaging position and a lowered, non-engaging position.

25. The panel cutting system of claim 18 and further comprising sensors positioned along said discharge chute for detecting passage of various varying lengths of the fabric material thereover, in response to which said cutting mechanism can be engaged for cutting the fabric material into panels of desired lengths.

* * * * *